United States Patent [19]

Oyer et al.

[11] Patent Number: 5,063,371

[45] Date of Patent: Nov. 5, 1991

[54] AIRCRAFT SECURITY SYSTEM

[76] Inventors: Michael W. Oyer, 124 Stony Gate, Carlisle, Mass. 01741; Algird M. Gudaitis, 13 Evelyn Rd., Stow, Mass. 01775

[21] Appl. No.: 455,246

[22] Filed: Dec. 22, 1989

Related U.S. Application Data

[62] Division of Ser. No. 913,139, Sep. 29, 1986, Pat. No. 4,933,668.

[51] Int. Cl.[5] ..... G08B 13/00

[52] U.S. Cl. ..... 340/541; 340/506; 340/517; 340/825.07; 340/825.54

[58] Field of Search ..... 340/505, 506, 511, 517, 340/518, 524, 541, 552, 555, 525, 825.07, 825.15, 825.16, 825.52, 825.54, 945, 825.06, 310 A, 507; 375/107; 364/424.01, 550

[56] References Cited

U.S. PATENT DOCUMENTS

| | | | |
|---|---|---|---|
| 3,327,289 | 6/1967 | Goldstine et al. . | |
| 3,838,411 | 9/1974 | Rapistan | 340/555 |
| 3,886,534 | 5/1975 | Rosen et al. | 340/525 |
| 3,925,763 | 12/1975 | Wadhwani et al. | 340/164 R |
| 3,974,488 | 8/1976 | Lederer | 340/555 |
| 4,019,172 | 4/1977 | Srodes | 340/146.1 C |
| 4,222,041 | 9/1980 | Von Tomkewitsch et al. | 340/517 |
| 4,237,536 | 12/1980 | Enelow et al. | 364/465 |
| 4,437,094 | 3/1984 | Fish | 340/644 |
| 4,524,354 | 6/1985 | Morgan | 340/525 |
| 4,562,428 | 12/1985 | Harman et al. | 340/552 |
| 4,573,041 | 2/1986 | Kitagawa et al. | 340/538 |
| 4,577,183 | 3/1986 | Fontaine et al. | 340/541 |
| 4,613,848 | 9/1986 | Watkins | 340/541 |
| 4,649,484 | 3/1987 | Herzog et al. | 364/424 |
| 4,658,243 | 4/1987 | Kimura et al. | 340/505 |
| 4,668,939 | 5/1987 | Kimura et al. | 340/525 |

FOREIGN PATENT DOCUMENTS

| | | |
|---|---|---|
| 2254168 | 7/1975 | France . |
| 2509889 | 1/1983 | France . |
| 2582430 | 11/1986 | France . |
| 8002631 | 11/1980 | PCT Int'l Appl. . |
| 87030405 | 6/1987 | PCT Int'l Appl. . |
| 1299427 | 11/1980 | United Kingdom . |

OTHER PUBLICATIONS

"MIL-STD-1553," *Harris CMOS Digital Data Book,* 1984, pp. 5-9.

"A 20-Mbaud Full Duplex Fiber Optic Data Link Using Fiber Optic Active Components." *Motorola Optoelectroics Device Data,* 1983, pp. 8-2 to 8-19.

*Primary Examiner*—Donnie L. Crosland
*Assistant Examiner*—Brent A. Swarthout
*Attorney, Agent, or Firm*—Wolf, Greenfield & Sacks

[57] ABSTRACT

An aircraft security system includes a central control unit, several remotely located cluster controllers and a plurality of intrusion sensors associated with and controlled by each cluster controller. A two-wire bus carries power from the central control unit for operating each of the cluster controllers and the sensors, and carries data signals in both directions between the central control unit and the cluster controllers. The two-wire bus reduces weight and installation costs. The system includes an initial calibration mode wherein sensor type information and sensor parameters are sent from the central control unit to each cluster controller. The signal strength from each sensor is then measured and stored in the central control unit. During later operation, the sensor signal strengths are measured and compared with the initial values. If a trouble condition is detected, appropriate corrective action is taken. One corrective action includes varying the transmitted energy until the sensor signal strength is within a prescribed range.

14 Claims, 4 Drawing Sheets

AIRCRAFT SECURITY SYSTEM

This application is a division of application Ser. No. 913,139, filed Sept, 29, 1986, now U.S. Pat. No. 4,933,668.

FIELD OF THE INVENTION

This invention relates to aircraft security systems and, more particularly, to aircraft security systems utilizing a number of intrusion sensors communicating with a central control unit, wherein all signalling and power are carried on a two-wire bus and wherein an initial calibration mode is utilized to insure reliable operation and reduce false alarms.

BACKGROUND OF THE INVENTION

The need has arisen for systems to protect aircraft against intrusion while they are parked at airports. While the need for security systems exists to some extent for all aircraft in all locations, the need is most acute in the case of private and business jets parked at foreign or unfamiliar airports. Security systems must protect against a variety of intrusions such as sabotage to the aircraft, placement of listening devices, smuggling, particularly of drugs, theft and acts of terrorism. To provide complete protection, the system must monitor not only entrances to the aircraft, but also access panels, engines, and wheel wells.

Aircraft security systems utilized in the past typically include a number of sensors at sensitive areas on the aircraft for detecting intrusions, and a control unit for monitoring the sensors and providing alarm indications. These systems must, of course, be reliable and have a low false alarm rate. In addition, certain requirements are unique to aircraft applications. For example, wires used to interconnect the various elements of the system must be minimized in weight and cost and must be easy to install. The installation of wire and cable in an already-completed aircraft is difficult, expensive and adds undesired weight. Accordingly, it is desirable to minimize the number of wires interconnecting the various elements. One prior art system utilizes two wires for data communication and two additional wires for carrying power to the various system elements. It is also desirable to minimize the power consumed by the system since batteries or other power supplies are typically the heaviest part of the system. An additional requirement of aircraft security systems is that RF radiation, which can interfere with aircraft communication and airport operations, be suppressed or eliminated.

A further requirement of aircraft security systems is that they maintain reliable operation over long periods of time when subjected to vibration, dirt, wide temperature variations, degradation with time, and, in the case of optical sensors, variation of ambient light conditions. Such conditions may cause sensors to stop operating without the knowledge of the aircraft personnel or may cause false alarms.

During the life of an aircraft security system, it is often desirable to change, remove or add sensors without requiring major system modifications to accommodate the altered sensor configuration.

It is a general object of the present invention to provide improved aircraft security systems and improved methods of operation for aircraft security systems.

It is another object of the present invention to provide aircraft security systems having reduced weight and which are easily installed in aircraft.

It is a further object of the present invention to provide aircraft security systems wherein power and data communication signals are carried between a central control unit and remotely-located sensor controllers on a two-wire bus.

It is still another object of the present invention to provide aircraft security systems and methods of operation which accommodate changes in sensor outputs caused by vibration, dirt, temperature variations, aging, ambient lighting, and other variable conditions.

It is yet another object of the present invention to provide aircraft security systems and methods of operations which can easily accommodate changes in sensor configurations.

SUMMARY OF THE INVENTION

According to the present invention, these and other objects and advantages are achieved in an aircraft signalling system comprising a central control unit including an onboard computer and an electrical power source, one or more cluster controllers, each remotely located from the central unit and including a microprocessor, and a plurality of sensors associated with and controlled by each cluster controller. The signalling system further includes a two-wire bus connecting the central unit and the cluster controllers. The bus carries operating power from the power source to the cluster controllers and the sensors, and carries digital data signals in both directions between onboard computer and the cluster controllers. The central control unit further includes first interface means for interfacing the power source and the onboard computer to the two-wire bus and the cluster controllers each further include second interface means for interfacing to the two-wire bus.

In a preferred embodiment, the first interface means includes a transformer having two secondary windings and the power source comprises a supply voltage source connected in series between the two secondary windings. The two-wire bus is connected across the series combination of the two secondary windings and the voltage source such that the supply voltage is carried on the bus. The digital data signals are coupled to a primary winding of the transformer. The second interface means in each cluster controller includes a transformer with two secondary windings. Each cluster controller includes a voltage regulator connected in series between the two secondary windings. The two-wire bus is connected across the series combination of the two secondary windings and the voltage regulator such that the supply voltage carried on the bus is delivered to the voltage regulator in each cluster controller.

It is preferred that each interface means include means for differentiating digital data signals received on the two-wire bus and for providing a voltage pulse of one polarity for each positive-going transition in the data signals and a voltage pulse of the opposite polarity for each negative-going transition in the data signals and comparator means for providing a first logic level when the voltage pulse of one polarity crosses a first threshold level and for providing a second logic level when the voltage pulse of the opposite polarity crosses a second threshold level.

The signalling system can include means for monitoring the current supplied on the two-wire bus and for disconnecting the power source from the bus when the current exceeds a prescribed level.

According to another aspect of the present invention, there is provided a method for operating an aircraft security system including an onboard computer, one or more cluster controllers remotely located from the onboard computer and connected by a communication link to the onboard computer, and a plurality of sensors associated with and controlled by each of the cluster controllers for sensing an alarm condition. The method comprises the steps of storing in the onboard computer memory type information and operating parameters for each of the plurality of sensors and transmitting the type information and the operating parameters to the respective cluster controllers when the system is to be put into operation.

In still another aspect of the present invention, a method of operating an aircraft security system includes the steps of interrogating each of the cluster controllers to obtain an initial signal strength from each of the sensors when the system is initialized, storing the initial signal strengths in the onboard computer memory, interrogating each of the cluster controllers to obtain a present signal strength from each of the sensors when the system is to be put into operation, and indicating a trouble condition when the difference between the present signal strength and the initial signal strength is outside a prescribed range.

According to still another aspect of the present invention, a method for operating an aircraft security system includes the steps of providing sensors including at least one transmitter and one receiver and transmitting a known signal from the transmitter to the receiver, interrogating the cluster controller to which the transmitter and receiver are connected to obtain a present received signal strength when the system is to be put into operation, sensing that the present signal strength is outside a prescribed range and directing the cluster controller to vary the energy sent by the transmitter to the receiver until the present signal strength is within the prescribed range.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
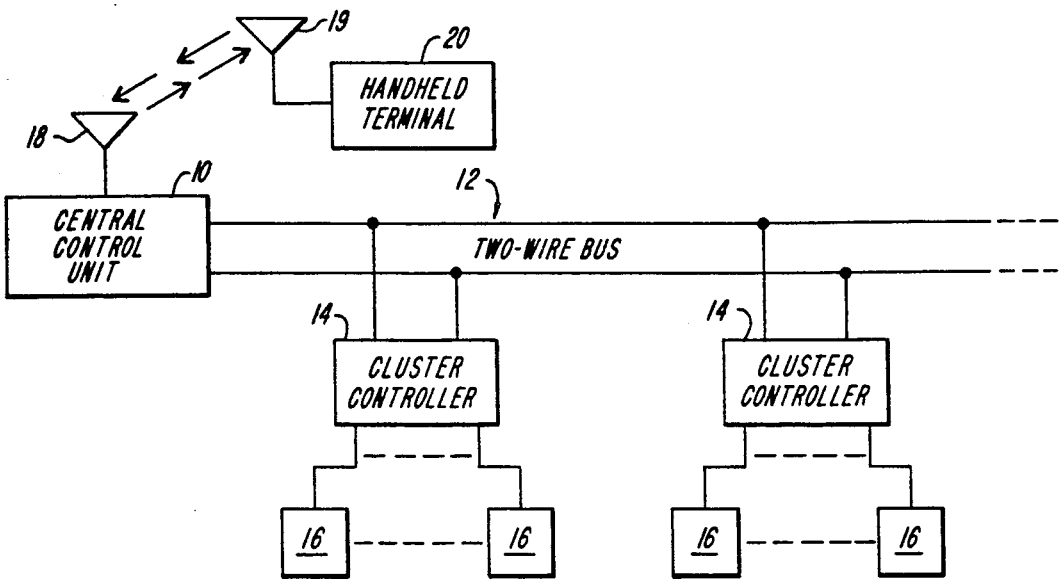
FIG. 1 is a block diagram of an aircraft security system in accordance with the present invention.

A block diagram of an aircraft security system in accordance with the present invention is shown in FIG. 1. The system includes a central control unit 10 which communicates over a two-wire bus 12 with one or more cluster controllers 14 commonly connected to the two-wire bus 12. A typical system includes several cluster controllers remotely located on the aircraft from the central control unit 10. Several intrusion sensors 16 are connected to each cluster controller 14. The sensors 16 are located in various parts of the aircraft, such as near doors, access panels, engines and wheel wells, to detect an intrusion and issue an alarm. Each cluster controller 14 is located near an associated group of sensors 16. The central control unit 10, which is located in an equipment rack or similar area on the aircraft, communicates through an onboard antenna 18 and a remote antenna 19 with a handheld terminal 20. The handheld terminal 20 is typically carried by the person responsible for the aircraft or is stored in a secure location off the aircraft. The system may also include an optional solar panel (not shown) for recharging system batteries and optional control terminals connected by cable or through an optical port.

The system shown in FIG. 1 is activated through the handheld terminal 20 when the aircraft is not being used. The cluster controllers 14 monitor the condition of each of the sensors 16 connected thereto and communicate the information to the central control unit 10 when interrogated. An alarm condition indicating an intrusion in the aircraft by an unauthorized individual is transmitted by the central control unit 10 to the handheld terminal 20. The two-wire bus 12 carries data communication in both directions between the central control unit 10 and the cluster controllers 14. In addition, the two-wire bus carries power from the central control unit 10 to each of the cluster controllers 14 and the sensors 16 for energizing these units.

Figure 2:
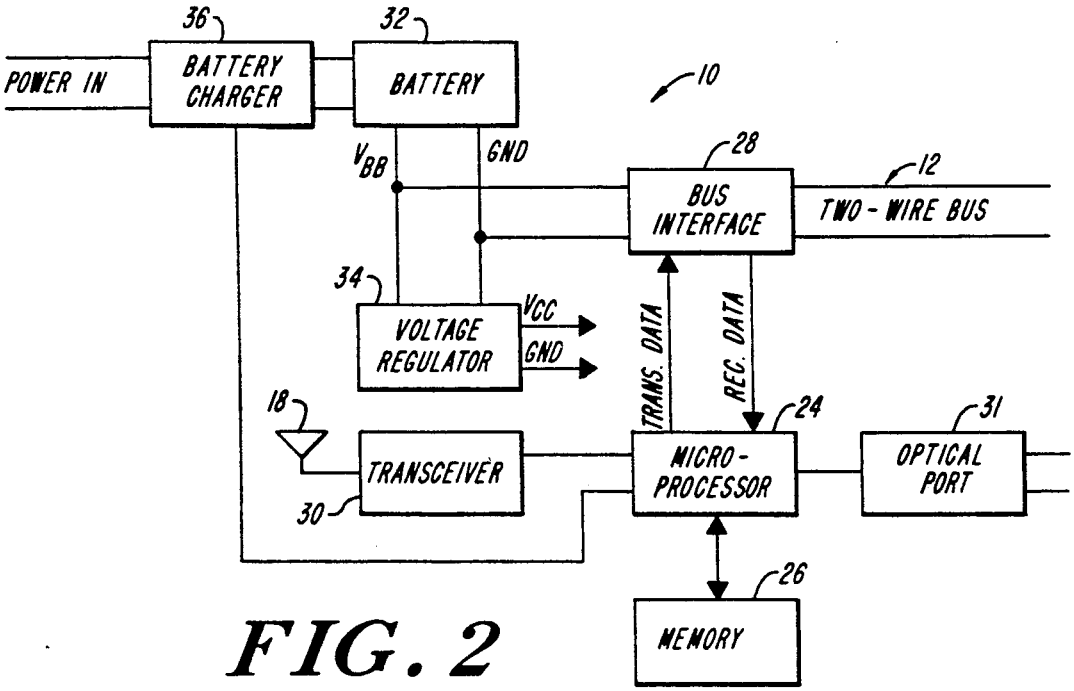
FIG. 2 is a block diagram of the central control unit of the aircraft security system shown in FIG. 1.

A block diagram of the central control unit 10 is shown in FIG. 2. An onboard computer including a microprocessor 24 and a memory 26 controls the operation of the security system. The memory 26 is connected to the microprocessor 24 and stores operating routines, sensor parameters, initial sensor signal levels and all other required instructions and data. The microprocessor 24 typically includes additional internal memory. In a preferred embodiment, the microprocessor 24 is a type 63701 eight bit microprocessor manufactured by Hitachi. Data transmitted to and received from the cluster controllers 14 is coupled by bus interface 28 to and from the two-wire bus 12. The microprocessor 24 communicates with the handheld terminal 20 by means of an RF transceiver 30 connected to antenna 18. The microprocessor 24 is also connected to an optical port 31 which is used for communication with an IR handheld terminal (not shown). The central control unit 10 further includes a battery 32 which supplies a voltage $V_{BB}$ to a voltage regulator 34 and to the bus interface 28. The voltage regulator 34 supplies a regulated voltage $V_{cc}$ to the various elements of the central control unit 10 such as microprocessor 24, memory 26, bus interface 28 and transceiver 30. More than one voltage can be supplied if necessary for the operation of the circuitry. The battery 32 voltage $V_{BB}$ is also supplied via the bus interface 28 to the two-wire bus 12 and is carried to the cluster controllers 14 as described in detail hereinafter. The entire security system is powered by the battery 32. A battery charger 36 is utilized to recharge the battery 32 from the aircraft power system when the aircraft is in flight and the security system is turned off.

Figure 3:
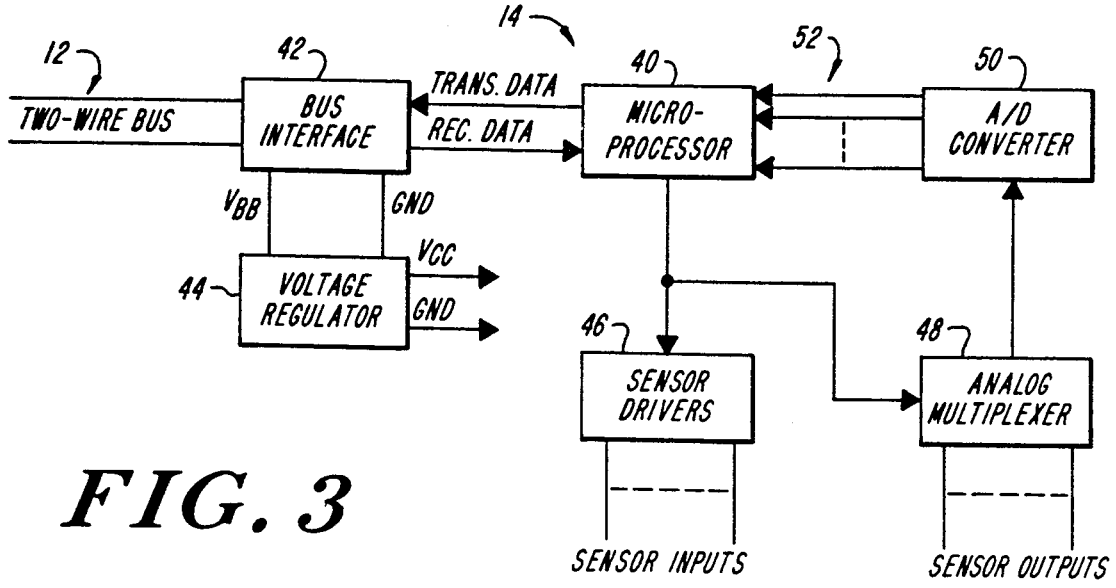
FIG 3 is a block diagram of the cluster controller of the aircraft security system shown in FIG. 1.

One of the cluster controllers 14 is shown in block diagram form in FIG. 3. A microprocessor 40 which contains internal memory and a universal asynchronous receiver transmitter (UART) controls communication with the central control unit 10 and activation and monitoring of the sensors 16 connected to the cluster controller 14. In a preferred embodiment, the microprocessor is a 63701 manufactured by Hitachi. Data transmitted to and received from the central control unit 10 is supplied through a bus interface 42 which sends and receives the data on the two-wire bus 12. The bus interface 42 separates the voltage $V_{BB}$ carried on the two-wire bus 12 from the data and supplies voltage $V_{BB}$ to a voltage regulator 44. Voltage regulator 44 regulates the voltage $V_{BB}$ and provides a regulated voltage $V_{cc}$ to the microprocessor 40 and to the other elements of the cluster controller 14. The cluster controller 14 further includes sensor drivers 46 which provide energizing signals of the required voltage, current and timing to each sensor 16 under control of the microprocessor 40. An analog multiplexer 48, also under control of the microprocessor 40, monitors the outputs of sensors 16 and provides a selected sensor output to an analog to digital (A/D) converter 50. The A/D converter 50 converts the output of the selected sensor 16 to digital form and supplies a digital sensor output 52 to the microprocessor 40.

Figure 4A:
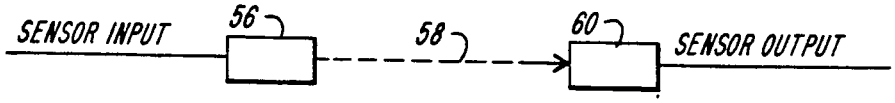
FIGS. 4A and 4B illustrate sensor configurations used in the aircraft security system of FIG. 1.
Figure 4B:
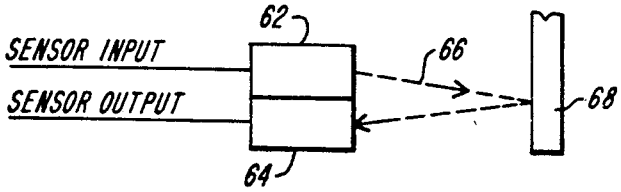

Typical sensor configurations are shown in FIGS. 4A and 4B. A beam type infrared (IR) sensor is shown in FIG. 4A. An infrared transmitter 56 emits an infrared beam 58 when it is energized by a sensor input signal, typically a pulse. The IR beam 58 is directed at an infrared receiver 60 positioned a known distance away. The IR beam 58 is converted to an electrical sensor output signal by the receiver 60. When the beam 58 is broken by an intruder, the IR beam 58 does not reach receiver 60 and an alarm condition is recognized. The configuration of FIG. 4A is typically used to protect a space such as an aircraft wheel well or other critical compartment. Several transmitter-receiver pairs can be used to protect one space.

Another sensor configuration shown in FIG. 4B utilizes an IR transmitter 62 and an IR receiver 64 in a reflective configuration. An IR beam 66 from the transmitter 62 is directed at an aircraft door 68 or other access panel. As long as the door 68 is in place, the beam is reflected by the door 68 to the receiver 64 and produces a sensor output signal. When the door 68 or other access panel is removed by an intruder, the beam 66 is no longer reflected and the sensor output signal disappears indicating an alarm condition. It will be understood that a variety of other sensor types can be utilized depending on the circumstances. For example, an inductive proximity sensor can be utilized, and switch closures or openings can indicate an alarm condition.

Figure 5:
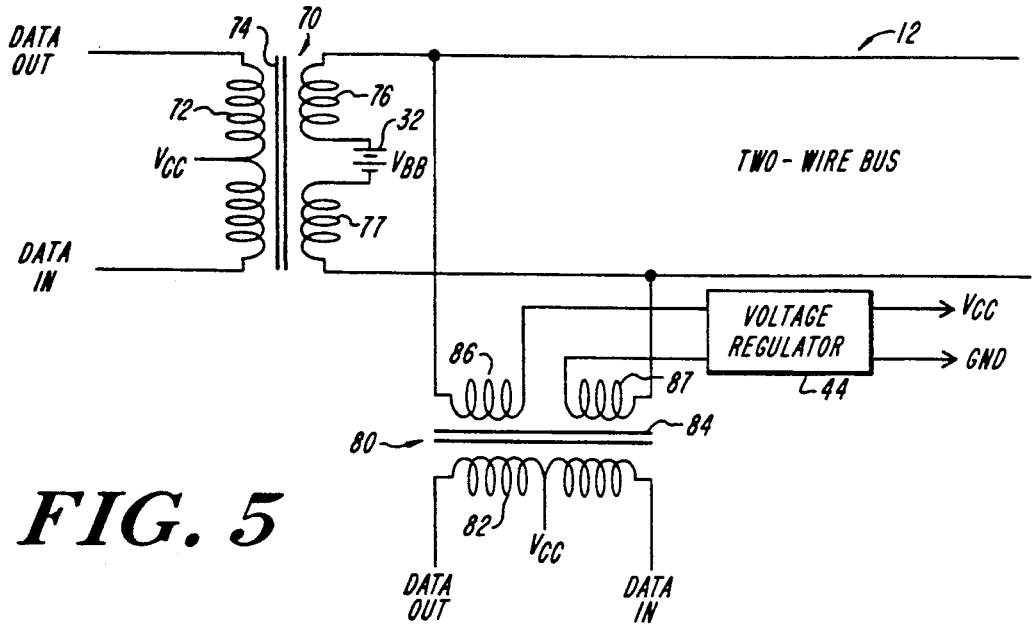
FIG. 5 is a simplified schematic diagram of a two-wire bus and bus interface circuitry in accordance with the present invention.

The configuration of the two-wire bus 12 utilized to transmit both power and data between the central control unit 10 and each of the controllers 14 is illustrated in simplified form in FIG. 5. A transformer 70 associated with the bus interface 28 in the central control unit 10 includes a center tapped primary winding 72, a core 74 and secondary windings 76, 77. The battery 32 is connected in series between the secondary windings 76 and 77. The conductors of the two-wire bus 12 are connected across the series combination of secondary windings 76, battery 32 and secondary winding 77. Data input to the bus 12 is supplied to one lead of primary winding 72 while data output from the bus 12 is taken from the other lead of the primary winding 72, as described in more detail hereinafter. The center tap of primary winding 72 is connected to the voltage $V_{cc}$.

A transformer 80 is associated with a cluster controller 14 includes a primary winding 82, a core 84 and secondary windings 86, 87. The voltage regulator 44 of the cluster controller 14 is connected in series between the secondary windings 86, 87. The other leads of secondary windings 86, 87 are connected to the conductors of the bus 12 so that the battery voltage $V_{BB}$ appears across secondary windings 86, 87. Data input from the cluster controller to the bus 12 is supplied to one lead of the primary winding 82 while data output from the bus 12 to the cluster controller 14 is taken from the other lead of primary winding 82. The data inputs and outputs to the two-wire bus 12 are coupled through the transformers 70, 80 and are not affected by the voltage $V_{BB}$ being carried on the bus 12 as long as $V_{BB}$ varies relatively slowly. The data signals appearing on the conductors of the bus 12 are isolated from the battery 32 by secondary windings 76, 77 and from voltage regulator 44 by secondary windings 86, 87. It will be seen that multiple cluster controllers 14 can be connected on the bus 12 so that the battery voltage $V_{BB}$ is provided to each cluster controller 14. Data is transmitted on the two-wire bus 12 in both directions between the central control unit 10 and each of the cluster controllers 14.

Figure 6:
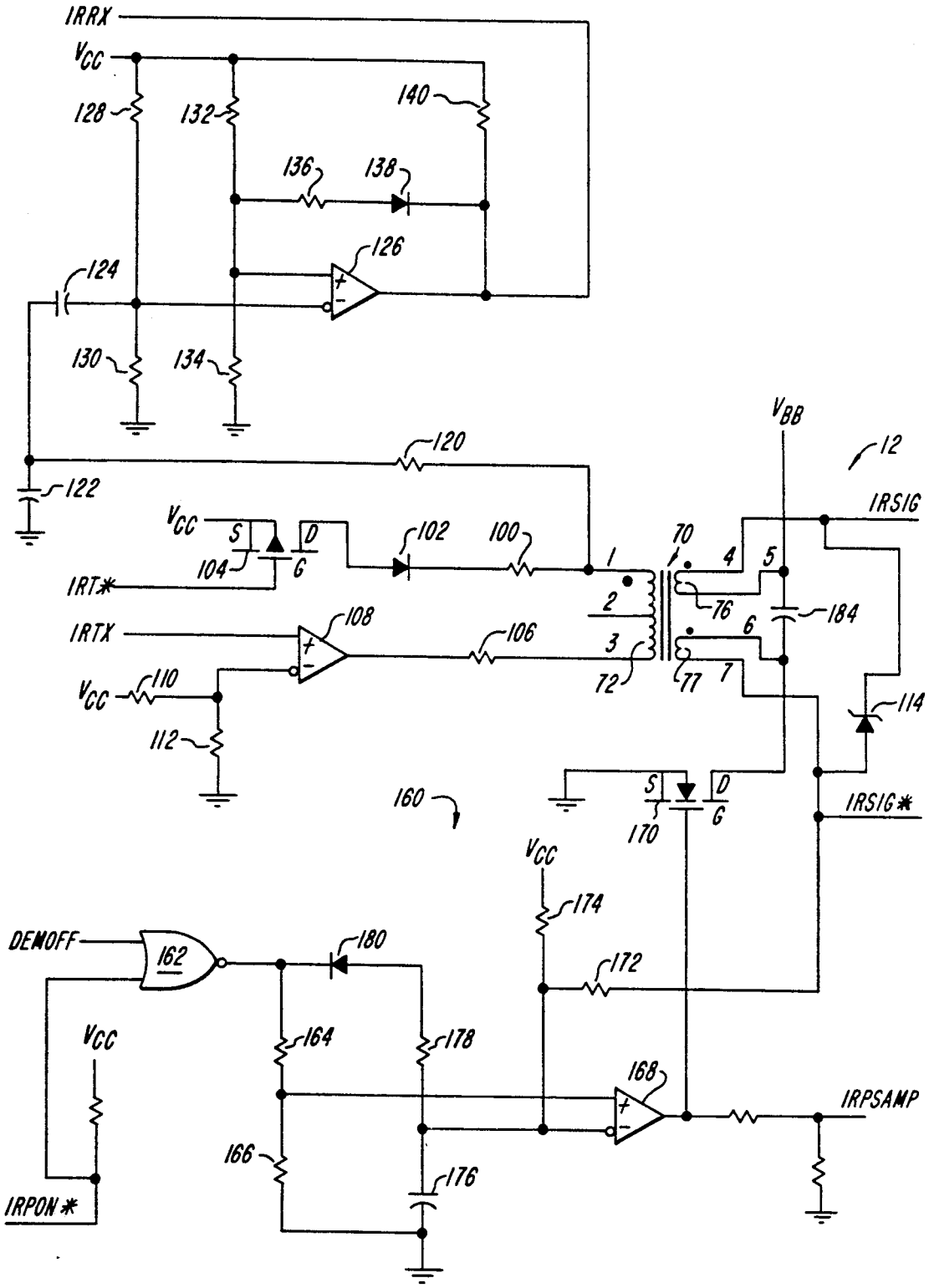
FIG. 6 is a schematic diagram of a bus interface circuit utilized in the central control unit.

The bus interface 28 in the central control unit 10 is shown in detail in FIG. 6. The transformer 70 is shown in FIG. 6 with leads numbered for ease of identification. Lead 1 of primary winding 72 is connected through a resistor 100 to the cathode of a diode 102. The anode of diode 102 is coupled to the drain electrode of a transistor 104. The source electrode of transistor 104 is coupled to the voltage $V_{cc}$, typically five volts. The gate electrode of transistor 104 is an input signal IRT*. Lead 3 of primary winding 72 is coupled through a resistor 106 to the output of an open collector comparator 108. The noninverting input of the comparator 108 is an input signal IRTX while the inverting input is connected to a reference voltage provided by a resistive divider including a resistor 110 coupled to supply voltage $V_{cc}$ and a resistor 112 coupled to ground. Lead 2 of primary winding 72, the center tap of the primary winding, is coupled to the supply voltage $V_{cc}$.

The battery voltage $V_{BB}$ is connected between lead 5 of secondary winding 76 and lead 6 of secondary winding 77. A decoupling capacitor 184 is connected across the leads 5 and 6 of transformer 70 to remove undesired current transients from the battery voltage $V_{BB}$. Lead 4 of secondary winding 76 is coupled to one of the conductors of the two-wire bus 12, designated as IRSIG. Lead 7 of secondary winding 77 is coupled to the other conductor of the two-wire bus 12 designated as IRSIG*. A zener diode 114 is coupled across the conductors of the two-wire bus to protect against high voltage transients.

When data is transmitted on the two-wire bus 12, the signal IRT*, which is an enable signal, is brought to a logic low, and the data signal is supplied on line IRTX to comparator 108. Current is caused to flow in the primary winding 72 of the transformer 70 and the data signal is coupled through the secondary windings 76, 77 onto the two-wire bus 12. The enable signal IRT* causes transistor 104 to turn on thereby connecting lead 1 of primary winding 72 to the supply voltage less the voltage of diode 102. The data supplied on the two-wire bus 12 is a conventional asynchronous communication protocol with a start bit, character bits and a stop bit, and parity bits if desired. The data transmitted through comparator 108 and transformer 70 to the two-wire bus is received by all of the cluster controllers 14.

When a signal is to be received by the central control unit 10, the signals IRT* and IRTX are both held at a high logic level so that transistor 104 and comparator 108 present an high impedance to the primary winding 72 of transformer 70. Data appearing on the two-wire bus 12 is coupled from secondary windings 76, 77 to the primary winding 72 of transformer 70. The data signal is extracted from the transformer 70 on lead 1 and is connected through a low pass filter circuit comprising a series resistor 120 and a shunt capacitor 122 connected to ground. The data signal is then coupled through a capacitor 124 which, in combination with its load resistors, acts as a differentiator of the data signal, and is coupled to the noninverting input of a comparator 126. The noninverting input of comparator 126 is biased at a prescribed DC voltage by a resistive divider comprising a resistor 128 connected to supply voltage $V_{cc}$ and a resistor 130 connected to ground. The inverting input of comparator 126 is also biased at a DC voltage by a resistive divider comprising a resistor 132 coupled to supply voltage $V_{cc}$ and a resistor 134 coupled to ground. In addition, a resistor 136 is coupled at one end to the noninverting input of comparator 126 and at the other end to the anode of a diode 138. The cathode of diode 138 is coupled to the output of comparator 126. A resistor 140 coupled between the output of comparator 126 and supply voltage $V_{cc}$ acts as a pull-up resistor for the output of comparator 126. Resistor 136 and diode 138 causes switching of the threshold level of comparator 126 depending on its output state in a well known manner. The output of comparator 126 is a signal IRRX which is the received data signal provided to the circuitry of the central control unit 10. It can be seen that when the output of comparator 126 is at a low logic level, current passes through resistor 136 and diode 138 acting as a partial bypass to resistor 134 and lowering the threshold voltage at the noninverting input of comparator 126. When the output of comparator 126 is at a high logic level, diode 136 is reverse biased and the reference level at the noninverting input is determined only by resistors 132 and 134. As a result, the threshold level is higher when the comparator 126 output is high.

Figure 7:
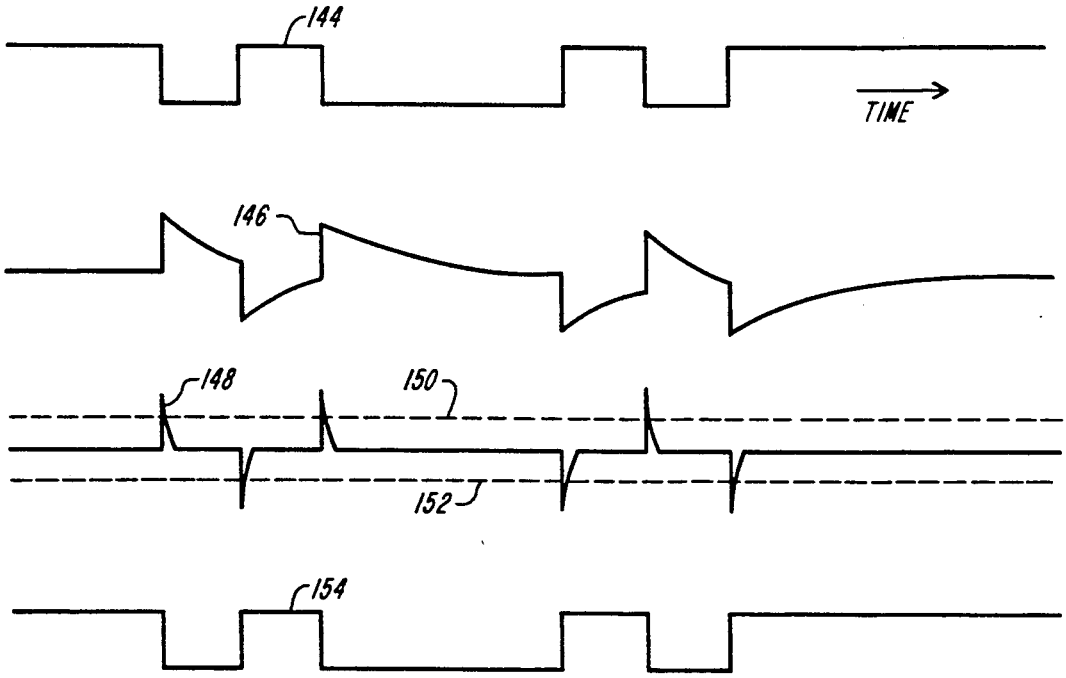
FIG 7 illustrates voltage waveforms in the bus interface circuit of FIG. 6.

The operation of the data receiver circuitry is illustrated in graphic form in FIG. 7 wherein the horizontal axis represents time. Waveform 144 shown in FIG. 7 is an input data signal to the bus interface 42 from a cluster controller 14 representing a series of data bits. Waveform 146 of FIG. 7 represents the output of transformer 70 on lead 1 of the primary winding 72. It can be seen that the transitions in the data are preserved and that the logic levels exhibit an exponential decay. Because of the data receiver used, the waveform degradation is not a problem, and a transformer 70 of moderate frequency response can be utilized. Waveform 148 in FIG. 7 represents the signal at the inverting input of comparator 126 after passing through the differentiating capacitor 124. The transitions in waveform 146 cause voltage pulses in the differentiated waveform 148. A negative pulse is produced for each negative transition in the waveform 146 while a positive pulse is produced for each positive transition in the waveform 146. The upper and lower thresholds of comparator 126 are represented by levels 150 and 152 in FIG. 7. It is preferred that the threshold levels 150 and 152 be equally spaced above and below the average value of waveform 148. Thus, each of the pulses in waveform 148 causes the output of comparator 126 to change to the opposite state, as shown by waveform 154 which represents the received data at the output of comparator 126.

A bus control and monitoring circuit 160 is shown in FIG. 6. The circuit 160 permits battery Power to be removed from the two-wire bus 12, thus deenergizing all cluster controllers 14 and sensors 16. In addition, the circuitry 160 monitors the DC current supplied on the bus 12 and removes power if the current exceeds a prescribed level which is indicative of a probable malfunction. Application of the battery power to the bus 12 is controlled by the logic input signals DEMOFF and IRPON* connected to a logic gate 162. The output of gate 162 is connected through a resistive divider comprising resistors 164 and 166 to the noninverting input of a comparator 168. The resistors 164, 166 establish a bias level at the comparator 168 noninverting input when the gate 162 output is at a high logic level. When the output of logic gate 162 is low, the bias level drops to approximately zero volts. The output of comparator 168 is coupled to the gate electrode of a transistor 170. The source and drain electrodes of transistor 170 are coupled in series with the battery circuit. Thus, when transistor 170 is turned off, the battery 32 is effectively disconnected from the bus 12. When gate 162 has a high output logic level, a positive voltage is provided to comparator 168 which in turn provides a high output level to transistor 170 and turns it on, thereby supplying battery power on the bus 12.

The current level on bus 12 is monitored by connecting lead 7 of secondary windings 77 of transformer 70 through a resistor 172 to the inverting input of comparator 168. Normally, a very low DC voltage developed across leads 6 and 7 of secondary winding 77 of transformer 70 and transistor 170. Accordingly, resistor 172 is effectively connected to ground and forms a resistive divider with a resistor 174 which is connected to supply voltage $V_{cc}$. Thus, the voltage at the inverting input of comparator 168 is normally maintained lower than the noninverting input and the output of comparator 168 remains high. When excessive current is drawn on the bus 12, a voltage builds up across secondary winding 77 of transformer 70 causing the voltage at the inverting input of comparator 168 to increase. The comparator 168 output goes low and turns off transistor 170 thereby disconnecting battery power from bus 12. A capacitor 176 is connected between the inverting input of comparator 168 and ground to insure that the monitoring signal is delayed when the system is powered up to allow a high current surge when first powering up the bus 12. A resistor 178 and a diode 180 are connected in series between the inverting input of comparator 168 and the output of gate 162 to partially discharge the capacitor 176 when the bus 12 power is turned off.

The circuitry shown in FIG. 6 represents the bus interface 28 in the central control unit 10. The bus interface 42 in each of the cluster controllers 14 is identical to the circuitry in bus interface 28 except that the bus control and monitoring circuit 160 is omitted and the leads 5 and 6 of the transformer are connected to voltage regulator 44 rather than battery 32. Thus, in bus interface 42 lead 6 of the transformer is connected directly to ground rather than through a transistor 170 as shown in FIG. 6. The transmission of data and the receiving of data in the bus interface 42 operate in an identical manner to that shown and described hereinabove in connection with bus interface 28.

The following list gives suitable values for the components shown in the circuit of FIG. 6. It will be understood that those values are given by way of example only.

| Component Type | Reference No. | Value or Part No. |
|---|---|---|
| Resistor | 128,132,112 | 100K ohms |
| Resistor | 130,178 | 47K ohms |
| Resistor | 134 | 82K ohms |
| Resistor | 136 | 15K ohms |
| Resistor | 140 | 22K ohms |
| Resistor | 120 | 12K ohms |
| Resistor | 100,106 | 470 ohms |
| Resistor | 174,164 | 220K ohms |
| Resistor | 166 | 470K ohms |
| Resistor | 172 | 430K ohms |
| Capacitor | 122,124 | 100 pf |
| Capacitor | 184 | 270 uf |
| Capacitor | 176 | 0.01 uf |
| Diode | 138,102,180 | 1N914 |
| Diode | 114 | 1N759 |
| Logic gate | 162 | SN7402 |

The comparators 108, 126 can be a type TLC372 manufactured by Texas Instruments. The comparator 168 can be a type ICL7631 manufactured by Intersil. Transistor 104 can be a type TP0602NZ manufactured by Supertex, while transistor 170 can be a type RFP12N08L manufactured by RCA. The transformer can be a type L8420 manufactured by PICO Electronics.

The communication protocol on the two-wire bus 12 utilizes a polling technique wherein the central control unit 10 sends sequential commands to each of the cluster controllers 14 and waits for a response. Cluster controllers 14 do not initiate signalling to the central control unit unless they are interrogated. The two-wire bus 12 carries digital data signals in both directions between the central control unit 10 and the cluster controllers 14. However, at any instant of time, data is being transmitted in one direction only. Conventional asynchronous RS232 character transmission with start and stop bits is utilized.

Typically, the microprocessor 24 in the central control unit 10 sends three types of messages to the cluster controller 14. The first is a POLL message which polls the cluster controllers for status reports. The message identifies a particular cluster controller. The second is an REQ message which requests signal intensity from a specified sensor. The message identifies the cluster controller and the sensor of interest. The third is an INIT message which initializes a specified cluster controller. The initialize message includes identification of the cluster controller and parameters for each sensor connected to the specified cluster controller. Sensor parameters includes sensor type, threshold levels and, in the case of infrared sensors, a transmitted pulse length.

The cluster controllers 14 utilize three message types in communicating with the microprocessor 24 in the central control unit 10. The first message is an ACK message which acknowledges a poll by the central control unit 10 and indicates no activity at that cluster controller. The message includes identification of the cluster controller. The second message is an REP message which reports signal intensity after a request by the central control unit 10. The message identifies the cluster controller and includes the sensor output data 52 from A/D converter 50 in the cluster controller 14 for the sensor identified by the central control unit. The third message is an ALARM message which indicates an alarm or trouble condition. The message identifies the cluster controller, identifies each sensor being reported and identifies duration and status of each sensor being reported. The duration indicates the time at which the alarm or trouble condition occurred relative to the last polling command, while the status indicates alarm-on, alarm-off, sensor in trouble, and more than one transition during the period.

During normal intrusion sensing operation, the sensors 16 are pulsed on periodically for short periods rather than being turned on continuously. The pulse operation reduces power consumption by the system and also improves detection capability since the cluster controller detects not only the presence of the signal when the sensor 16 is energized but also the absence of a signal when the sensor is not energized. The system, in fact, detects transitions between the on and off states. Therefore, attempts to compromise the system by use of, for example, a continuous infrared source would not be successful. Typically the sensors are turned on four times per second for periods on the order of microseconds. Any alarm or trouble conditions are stored by the cluster controller 14. The central control unit 10 sequentially polls each of the cluster controllers 14, and the status of the sensors 16 is reported to the central control unit 10. Preferably, each cluster controller is polled on the order of once per second to avoid delay in detecting alarm conditions.

In accordance with the present invention, the aircraft security system utilizes an initialization mode for improving the system reliability and compensating for environmental factors such as temperature variations, ambient light, dirt, vibration or other factors which may affect the outputs of sensor 16. Such environmental factors may cause the sensors to degrade or fail entirely so that actual alarm conditions are not reported, or may cause the sensors to give false alarm indications.

To overcome these difficulties, the system of the present invention, upon initial installation in the aircraft, requests the signal intensity from each of the sensors connected to the system and stores these values in the memory 26. These initial signal strengths are later used for comparison. Subsequently, each time the system is activated, the central control unit 10 again requests the signal intensity from each of the sensors 16 in the system. The present signal strengths are compared with the initial signal strengths stored in the memory 26. If the difference between the present value and the initial value is outside a prescribed range for any of the sensors, a trouble condition is indicated for that sensor. The trouble condition indicates that that sensor is not functioning properly for some reason and permits corrective action to be taken. Clearly, if the sensor has failed, servicing will be required. When, however, the sensor output has degraded due to temperature, age, vibration, or other factors, the system includes means for correcting the trouble condition. Referring to FIG. 4A, when the sensor output is outside its prescribed range, the central control unit 10 directs the cluster controller 14 to increase or decrease the energy being transmitted by transmitter 56. In the case of pulsed operation, this is accomplished by increasing the pulse width. The pulse width is increased or decreased by a prescribed amount and the signal intensity from the sensor is again measured. This process is repeated until the sensor output is brought within the prescribed range of outputs.

During normal operation, a trouble condition can be detected by the cluster controller 14. Typically, each sensor has three associated threshold levels. One threshold determines the boundary between alarm-on and alarm-off while the other two thresholds establish a window or range outside of which a trouble condition is indicated.

A further feature of the initializing mode includes the transmission of the sensor type and operating parameters for each sensor to the cluster controllers. The information is stored in the memory 26 of the central control unit 10 and can be updated as sensors are added, changed or removed from the system. The information is transmitted in INIT message as described above for each sensor connected to a cluster controller 14. The type of sensor is specified, alarm and trouble thresholds are specified and the length of the infrared path is specified when appropriate. It will be understood that other sensor information can be transmitted if desired. Thus, the central control unit stores all initialization information and can be easily updated. The information is sent to the appropriate cluster controller 14 each time the system is activated, for example, when parking at an airport.

While the system described herein is particularly useful for aircraft security, it will be understood that the system can also be used for security in boats or other vehicles, buildings, and the like, and for other signalling applications.

While there has been shown and described what is at present considered the preferred embodiments of the present invention, it will be obvious to those skilled in the art that various changes and modifications may be made therein without departing from the scope of the invention as defined by the appended claims.

What is claimed is:

1. An aircraft security system comprising:

an onboard computer;

one or more cluster controllers remotely located from said onboard computer;

a plurality of sensors associated with and controlled by each of said cluster controllers, each of said sensors generating a sensor signal in response to sensing a security condition;

means for communication between said onboard computer and said cluster controllers, each of said cluster controllers transmitting said sensor signal to said onboard computer for generation of a security indication; and said onboard computer including means for storing type information and operating parameters for each of said plurality of sensors and for transmitting the type information and the operating parameters to the associated cluster controller when said system is to be put into operation, said type information and operating parameters identifying the type and operating characteristics of each of said sensors.

2. An aircraft security system as defined in claim 1 wherein said onboard computer further includes means for interrogating each of said cluster controllers when said system in initialized to obtain an initial signal strength generated by each of said sensors in response to sensing a predetermined condition, means for storing said initial signal strength for each of said sensors, means for interrogating each of said cluster controllers when said system is to be put into operation to obtain a present signal strength generated by each of said sensors in response to sensing said predetermined condition, and means for indicating a trouble condition when the difference between said present signal strength and said initial signal strength for a sensor is outside a prescribed range.

3. An aircraft security system as defined in claim 1 wherein at least one of said sensors includes a transmitter and a receiver, wherein said transmitter sends a known signal to said receiver and wherein said onboard computer includes means for interrogating the specified cluster controller with which the transmitter and the receiver are associated to obtain a present signal strength generated by said receiver in response to said known signal, when said system is to be put into operation, and means for sensing that said present signal strength is outside a prescribed range and for directing the specified cluster controller to vary the energy sent by said transmitter to said receiver until said present signal strength is within said prescribed range.

4. A method for operating an aircraft security system including an onboard computer, one or more cluster controllers remotely located from the onboard computer and connected by a communication link to said onboard computer, and a plurality of sensors associated with and controller by each of the cluster controllers, each of said sensors generating a sensor signal in response to sensing a security condition, each of said cluster controllers transmitting said sensor signal to said onboard computer for generation of a security indication, said method comprising the steps of:

storing type information and operating parameters for each of said plurality of sensors in said onboard computer, said type information and operating parameters identifying the type and operating characteristics of each of said sensors; and transmitting the type information and the operating parameters to the respective cluster controllers when said system is to be put into operation.

5. A method for operating an aircraft security system as defined in claim 4 further including the steps of interrogating each of said cluster controllers to obtain an initial signal strength generated by each of said sensors in response to sensing a predetermined condition when said system is initialized, storing said initial signal strength for each of said sensors in said onboard computer, interrogating each of said cluster controllers when said system is to be put into operation to obtain a present signal strength generated by each of said sensors in response to sensing said predetermined condition, and indicating a trouble condition when the difference between said present signal strength and said initial signal strength is outside a prescribed range.

6. A method for operating an aircraft security system as defined in claim 4 further including providing sensors including at least one transmitter and one receiver, transmitting a known signal from said transmitter to said receiver, interrogating the cluster controller to which the transmitter and receiver are connected to obtain a present signal strength generated by said receiver in response to said known signal, when said system is to be put into operation, sensing that said present signal strength is outside a prescribed range, and directing the cluster controller to vary the energy sent by said transmitter to said receiver until said present signal strength is within said prescribed range.

7. A security system comprising:

a central computer;

one or more cluster controllers remotely located from said computer;

a plurality of sensors associated with and controlled by each of said cluster controllers, each of said sensors generating a sensor signal in response to sensing a security condition;

means for communication between said computer and said cluster controllers, each of said cluster controllers transmitting said sensor signal to said onboard computer for generation of a security indication; and said computer including means for storing type information and operating parameters for each of said plurality of sensors and for transmitting the type information and the operating parameters to the associated cluster controller when said system is to be put into operation, said type information and operating parameters identifying the type and operating characteristics of each of said sensors.

8. A sensing and communication system comprising:

a computer;

one or more cluster controllers remotely located from said computer;

a plurality of sensors associated with and controlled by each of said cluster controllers, each of said sensors generating a sensor signal in response to sensing a prescribed condition;

means for communication between said computer and said cluster controllers, each of said cluster controllers transmitting said sensor signal to said onboard computer; and said computer including means for storing type information and operating parameters for each of said plurality of sensors and for transmitting the type information and the operating parameters to the associated cluster controller when said system is to be put into operation, said type information and operating parameters identifying the type and operating characteristics of each of said sensors.

9. A sensing and communication system as defined in claim 8 wherein said computer further includes means for interrogating each of said cluster controllers when said system is initialized to obtain an initial signal strength generated by each of said sensors in response to sensing a predetermined condition, means for storing said initial signal strength for each of said sensors, means for interrogating each of said cluster controllers when said system is to be put into operation, to obtain a present signal strength generated by each of said sensors in response to sensing said predetermined condition, and means for indicating a trouble condition when the difference between said present signal strength and said initial signal strength for a sensor is outside a prescribed range.

10. A sensing and communication system as defined in claim 8 wherein at least one of said sensors includes a transmitter and a receiver, wherein said transmitter sends a known signal to said receiver and wherein said computer includes means for interrogating the specified cluster controller with which the transmitter and the receiver are associated to obtain a present signal strength generated by said receiver in response to said known signal when said system is to be put into operation, and means for sensing that said present signal strength is outside a prescribed range and for directing the specified cluster controller to vary the energy sent by said transmitter to said receiver until said present signal strength is within said prescribed range.

11. A method for operating a sensing and communication system including a computer, one or more cluster controllers remotely located from the computer and connected by a communication link to said computer, and a plurality of sensors associated with and controlled by each of the cluster controllers, each of said sensors generating a sensor signal in response to sensing a prescribed condition, each of said cluster controllers transmitting said sensor signal to said computer, said method comprising the steps of:

storing type information and operating parameters for each of said plurality of sensors in said computer, said type information and operating parameters identifying the type and operating characteristics of each of said sensors; and transmitting the type information and the operating parameters to the respective cluster controllers when said system is to be put into operation.

12. A method for operating a sensing and communication system as defined in claim 11 further including the steps of interrogating each of said cluster controllers when said system is initialized to obtain an initial signal strength generated by each of said sensors in response to sensing a predetermined condition, storing said initial signal strength of each of said sensors in said computer, interrogating each of said cluster controllers when said system is to be put into operation to obtain a present signal strength generated by each of said sensors in response to sensing said predetermined condition, and indicating a trouble condition when the difference between said present signal strength and said initial signal strength is outside a prescribed range.

13. A method for operating a sensing and communication system as defined in claim 11 further including providing sensors including at least one transmitter and one receiver, transmitting a known signal from said transmitter to said receiver, interrogating the cluster controller to which the transmitter and receiver are connected to obtain a present signal strength generated by said receiver in response to said known signal when said system is to be put into operation, sensing that said present signal strength is outside a prescribed range, and directing the cluster controller to vary the energy sent by said transmitter to said receiver until said present signal strength is within said prescribed range.

14. A security system as defined in claim 1 further including means associated with said onboard computer for transmitting said security indication to a remote location.

* * * * *